United States Patent [19]

Sugimoto

[11] 4,091,646

[45] May 30, 1978

[54] HOLDER FOR KEYS AND THE LIKE

[76] Inventor: George Sugimoto, 1195 Dominion St., Winnipeg, Canada, R3E 2P6

[21] Appl. No.: 810,487

[22] Filed: June 27, 1977

[51] Int. Cl.[2] ..... A44B 15/00

[52] U.S. Cl. ..... 70/456 R; 70/459

[58] Field of Search ..... 70/456 R, 456 B, 457, 70/458, 459; 24/3 K, 276, 243 B, 248 SA

[56] References Cited

FOREIGN PATENT DOCUMENTS

| | | | |
|---|---|---|---|
| 976,141 | 10/1950 | France | 70/459 |
| 988,112 | 4/1951 | France | 70/459 |
| 28,370 of | 1904 | United Kingdom | 70/459 |

*Primary Examiner*—Robert L. Wolfe

*Attorney, Agent, or Firm*—Stanley G. Ade

[57] ABSTRACT

Two elements are hinged together by one end thereof and are detachably locked by the other ends to form the key holder. The detachable locking means includes in one embodiment, a cylindrical member having a slot therein and being screw threaded on the outer surface. The engaging ends of the element are kinked or misaligned and will enter the slots. A closure nut is screw threadably engageable on the screw threaded outer surface of the cylindrical member thus closing the slot. The outer side of the nut is apertured to permit free rotation of the nut on the element but preventing axial disengagement of the element from the nut when engaged on the cylindrical member. Another embodiment is provided with detachable locks at each adjacent pair of ends of the holder with the slots on one side being a relatively loose fit to permit the other ends to be displaced sideways from one another when the lock of the one ends are disconnected so that keys can be removed or replaced upon the holder.

16 Claims, 8 Drawing Figures

HOLDER FOR KEYS AND THE LIKE

BACKGROUND OF THE INVENTION

This invention relates to new and useful improvements in holders for keys and the like. Conventionally such key rings or holders comprise split rings which are difficult to manipulate in order to remove or replace keys thereon.

Other types of key holders are known but it is believed that the present device is of a simple and improved construction which may readily be manufactured and manipulated during use.

SUMMARY OF THE INVENTION

The present device consists of a holder for keys and the like which comprises a pair of curved rod-like elements pivotally connected adjacent one end thereof and having detachable locking means connected adjacent the other ends thereof. Said detachable locking means includes a substantially cylindrical member secured to the end of one of said elements and detachably secured to the end of the other of said elements. Said last mentioned means includes a slot formed in said member extending from the end of said member adjacent said end of the other element along one side of said member, to a point spaced from said end. The outer wall of said member through which said slot is formed, is screw threaded and fastening means freely engage the other element and screw threadably engage the screw threaded outer wall of the member. Means are provided on the element to restrain displacement of the element from the member when the fastening means is screw threadably engageable with said member.

Another aspect of the invention comprises the member being detachably secured to both adjacent ends of the elements with sufficient width of slot being provided so that when the locking means are disconnected at one end of the members, the two members may be displaced sideways so that keys or the like may be installed or removed from the elements.

An object of the invention is to provide a device of the character herewithin described which is easily manipulated during use and yet which cannot become disconnected inadvertently once the detachable locking means has been engaged.

Another object of the invention is to provide a device of the character herewithin described which is simple in construction, economical in manufacture and otherwise well suited to the purpose for which it is designed.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

BRIEF DESCRIPTION OF THE DRAWINGS

In the drawings like characters of reference indicate corresponding parts in the different figures.

DETAILED DESCRIPTION

Figure 1:
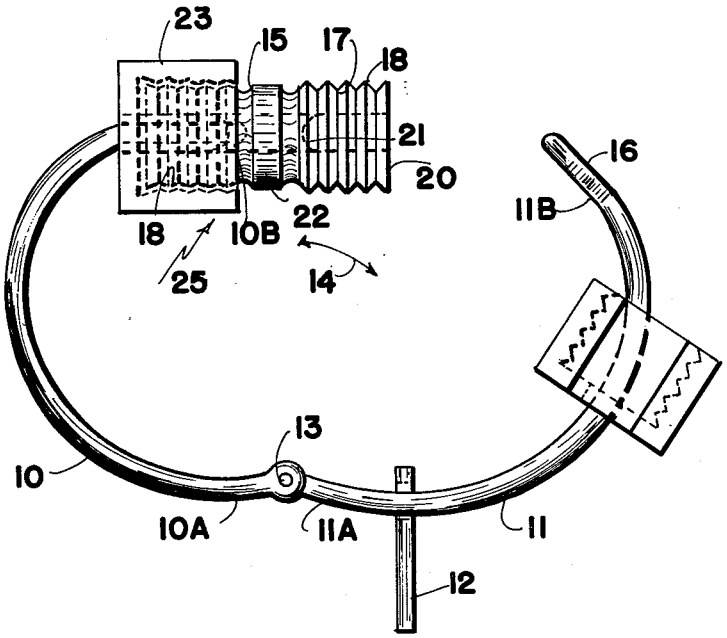
FIG. 1 is a front elevation of one embodiment.

Proceeding therefore to describe the invention in detail, reference should first be made to FIGS. 1 through 6.

The holder comprises a pair of elements 10 and 11 formed preferably from round stock such as rod and curved as illustrated so that when adjacent ends of the elements are placed together, a substantially ring-like construction is provided upon which keys 12 or the like may be retained.

In this embodiment, adjacent one ends 10A and 11A are pivotally connected together by means of pivot pin 13, so that adjacent other ends 10B and 11B may be moved apart from one another in the direction of doubled headed arrow 14.

Means are provided to detachably secure said other ends together, said means taking the form of a substantially cylindrical member 15 one end of which may be secured permanently to one end 10B of the elements if desired.

However, preferably, the cylindrical member 15 is detachably secured to both ends 10B and 11B of the elements as illustrated.

Figure 2:
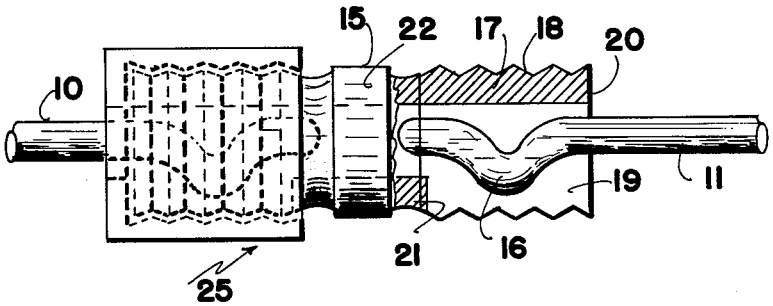
FIG. 2 is an enlarged partially fragmented view of FIG. 1 shown closed.
Figure 3:
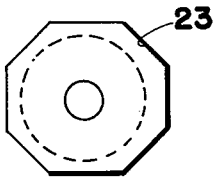
FIG. 3 is an end view of the locking nut per se.
Figure 4:
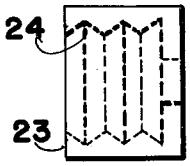
FIG. 4 is a side view of FIG. 3.
Figure 5:
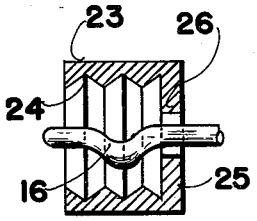
FIG. 5 is a sectional view of FIG. 4 showing one end of the element therein.

Each end portion 10B and 11B is provided with a projecting portion 16 formed, in this embodiment, by distorting the length of the end portion sideways to form a kinked end as clearly shown in FIG. 2.

Figure 6:
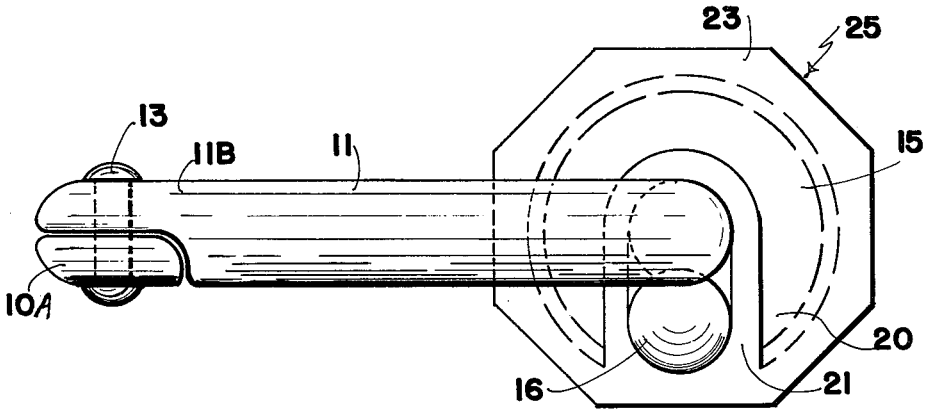
FIG. 6 is an end view of FIG. 1 shown closed.

The outer ends 17 of the cylindrical member 15 are screw threaded as illustrated by reference character 18 and are also provided with a slot 19 which extends from the outer end walls 20 to a point 21 spaced from these outer end walls and extending through the side of the end portion 17 as illustrated in FIGS. 2 and 6. A hollow bore 22 extends through the central portion of the member 15 and connects with the slots as illustrated.

Retaining means are provided and take the form of a hollow nut component 23 internally screw threaded as at 24 and having a centrally apertured end plate 25 on one end thereof which is adapted to receive the substantially cylindrical elements 10 or 11 so that the nut may be freely rotated thereon.

In operation, the necessary keys or the like 12 are placed on the elements 10 or 11 whereupon the other ends 10B and 11B are moved towards one another and engaged within the slots 19 of the member 22.

The nuts 23 are then engaged over the screw threaded outer surfaces 18 of the ends of the member 22 and are tightened thus retaining the kinked ends 16 within the slots with the kinked ends or projecting portions 16 preventing the elements from being withdrawn through the centrally formed apertures 26 of the nuts because of the diameter of these apertures which are just sufficient to provide free rotation of the nut on the elements 10 or 11.

Figure 7:
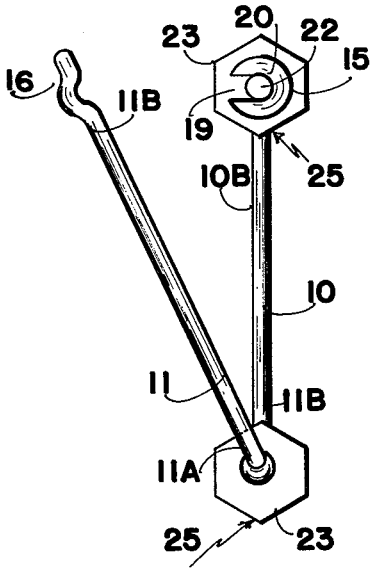
FIG. 7 is an end view of an alternative embodiment.
Figure 8:
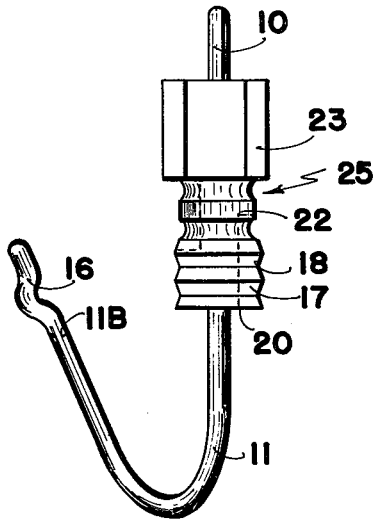
FIG. 8 is a top plan view of FIG. 7.

FIGS. 7 and 8 show a similar construction with the exception that the pivotal connection between the one ends 10A and 11A of the elements, is formed by a similar locking assembly as shown in FIGS. 2 to 6.

However in this embodiment, the locking assembly collectively designated 25, is provided with slots 19 which are slightly wider than the width of the ends 10A and 11A of the elements so that when the upper locking assembly 27 is disconnected, the two elements may be swung sideways from one another as clearly shown in FIG. 7, to permit the engagement or disengagement of keys or the like upon the elements 10 or 11.

It will of course be understood that the ends 10A and 11A of the elements 10 and 11, in this embodiment, are provided with kinked ends such as illustrated by reference character 16, and as hereinbefore described with reference to the locking assemblies on the other ends 10B and 11B.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention:

1. A holder for keys and the like comprising in combination a pair of curved rod-like elements, means pivotally connecting adjacent one ends of the elements together and detachable locking means connecting adjacent other ends of the elements together, said detachable locking means including a substantially cylindrical member, means securing same to the end of one of said elements, and means detachably securing same to the end of the other of said elements, said last mentioned means including a slot formed in said member and extending from the end of said member adjacent said end of said other element along one side of said member, to a point spaced from said end of said member, the outer wall of said member through which said slot is formed, being screw threaded, an fastening means freely engaging said other element and screw threadably engaging said screw threaded outer wall of said member, and means on said other element restraining displacement of said other element from said member when said fastening means is screw threadably engageable with said member as aforesaid.

2. The invention according to claim 1 in which said fastening means takes the form of a nut having an apertured end plate on one side thereof.

3. The invention according to claim 2 in which said means on said element restraining displacement of said element includes a portion adjacent said one end of said other element being displaced axially from said element, said portion engaging within said slot whereby said nut restrains endwise movement of said element from said member when said nut is engaged with said member.

4. The invention according to claim 3 in which said projection is formed by distorting said portion to form a kinked end to said element.

5. The invention according to claim 1 in which said cylindrical element is detachably secured to said end of said one element.

6. The invention according to claim 2 in which said cylindrical element is detachably secured to said end of said one element.

7. The invention according to claim 3 in which said cylindrical element is detachably secured to said end of said one element.

8. The invention according to claim 4 in which said cylindrical element is detachably secured to said end of said one element.

9. The invention according to claim 1 in which said means for connecting adjacent one ends together also comprises detachable locking means connected adjacent said one ends of said elements, said detachable locking means including a substantially cylindrical member, means securing same to the end of one of said one elements and means detachably securing same to the end of the other of said one elements, said last mentioned means including a slot formed in said member extending from the end of said member adjacent said end of said one element, along one side of said member to a point spaced from said end, the outer wall of said member through which said slot is formed, being screw threaded, and fastening means freely engaging said other element and screw threadably engaging said screw threaded outer wall of said member and means on said element restraining displacement of said element from said member when said fastening means is screw threadably engageable with said member as aforesaid, the width of said slot being sufficient to permit rotational displacement of said other ends of said elements one from the other when said other ends are disconnected, whereby keys and the like may be installed and removed from said elements.

10. The invention according to claim 2 in which said means for connecting adjacent one ends together also comprises detachable locking means connected adjacent said one ends of said elements, said detachable locking means including a substantially cylindrical member, means securing same to the end of one of said one elements and means detachably securing same to the end of the other of said one elements, said last mentioned means including a slot formed in said member extending from the end of said member adjacent said end of said one element, along one side of said member to a point spaced from said end, the outer wall of said member through which said slot is formed, being screw threaded, and fastening means freely engaging said other element and screw threadably engaging said screw threaded outer wall of said member and means on said element restraining displacement of said element from said member when said fastening means is screw threadably engageable with said member as aforesaid, the width of said slot being sufficient to permit rotational displacement of said other ends of said elements one from the other when said other ends are disconnected, whereby keys and the like may be installed and removed from said elements.

11. The invention according to claim 3 in which said means for connecting adjacent one ends together also comprises detachable locking means connected adjacent said one ends of said elements, said detachable locking means including a substantially cylindrical member, means securing same to the end of one of said one elements and means detachably securing same to the end of the other of said one elements, said last mentioned means including a slot formed in said member extending from the end of said member adjacent said end of said one element, along one side of said member to a point spaced from said end, the outer wall of said member through which said slot is formed, being screw threaded, and fastening means freely engaging said other element and screw threadably engaging said screw threaded outer wall of said member and means on said element restraining displacement of said element from said member when said fastening means is screw threadably engageable with said member as aforesaid, the width of said slot being sufficient to permit rotational displacement of said other ends of said elements one from the other when said other ends are disconnected, whereby keys and the like may be installed and removed from said elements.

12. The invention according to claim 4 in which said means for connecting adjacent one ends together also comprises detachable locking means connected adjacent said one ends of said elements, said detachable locking means including a substantially cylindrical member, means securing same to the end of one of said one elements and means detachably securing same to the end of the other of said one elements, said last mentioned means including a slot formed in said member extending from the end of said member adjacent said end of said one element, along one side of said member to a point spaced from said end, the outer wall of said member through which said slot is formed, being screw threaded, and fastening means freely engaging said other element and screw threadably engaging said screw threaded outer wall of said member and means on said element restraining displacement of said element from said member when said fastening means is screw threadably engageable with said member as aforesaid, the width of said slot being sufficient to permit rotational displacement of said other ends of said elements one from the other when said other ends are disconnected, whereby keys and the like may be installed and removed from said elements.

13. The invention according to claim 5 in which said means for connecting adjacent one ends together also comprises detachable locking means connected adjacent said one ends of said elements, said detachable locking means including a substantially cylindrical member, means securing same to the end of one of said one elements and means detachably securing same to the end of the other of said one elements, said last mentioned means including a slot formed in said member extending from the end of said member adjacent said end of said one element, along one side of said member to a point spaced from said end, the outer wall of said member through which said slot is formed, being screw threaded, and fastening means freely engaging said other element and screw threadably engaging said screw threaded outer wall of said member and means on said element restraining displacement of said element from said member when said fastening means is screw threadably engageable with said member as aforesaid, the width of said slot being sufficient to permit rotational displacement of said other ends of said elements one from the other when said other ends are disconnected, whereby keys and the like may be installed and removed from said elements.

14. The invention according to claim 6 in which said means for connecting adjacent one ends together also comprises detachable locking means connected adjacent said one ends of said elements, said detachable locking means including a substantially cylindrical member, means securing same to the end of one of said one elements and means detachably securing same to the end of the other of said one elements, said last mentioned means including a slot formed in said member extending from the end of said member adjacent said end of said one element, along one side of said member to a point spaced from said end, the outer wall of said member through which said slot is formed, being screw threaded, and fastening means freely engaging said other element and screw threadably engaging said screw threaded outer wall of said member and means on said element restraining displacement of said element from said member when said fastening means is screw threadably engageable with said member as aforesaid, the width of said slot being sufficient to permit rotational displacement of said other ends of said elements one from the other when said other ends are disconnected, whereby keys and the like may be installed and removed from said elements.

15. The invention according to claim 7 in which said means for connecting adjacent one ends together also comprises detachable locking means connected adjacent said one ends of said elements, said detachable locking means including a substantially cylindrical member, means securing same to the end of one of said one elements and means detachably securing same to the end of the other of said one elements, said last mentioned means including a slot formed in said member extending from the end of said member adjacent said end of said one element, along one side of said member to a point spaced from said end, the outer wall of said member through which said slot is formed, being screw threaded, and fastening means freely engaging said other element and screw threadably engaging said screw threaded outer wall of said member and means on said element restraining displacement of said element from said member when said fastening means is screw threadably engageable with said member as aforesaid, the width of said slot being sufficient to permit rotational displacement of said other ends of said elements one from the other when said other ends are disconnected, whereby keys and the like may be installed and removed from said elements.

16. The invention according to claim 8 in which said means for connecting adjacent one ends together also comprises detachable locking means connected adjacent said one ends of said elements, said detachable locking means including a substantially cylindrical member, means securing same to the end of one of said one elements and means detachably securing same to the end of the other of said one elements, said last mentioned means including a slot formed in said member extending from the end of said member adjacent said end of said one element, along one side of said member to a point spaced from said end, the outer wall of said member through which said slot is formed, being screw threaded, and fastening means freely engaging said other element and screw threadably engaging said screw threaded outer wall of said member and means on said element restraining displacement of said element from said member when said fastening means is screw threadably engageable with said member as aforesaid, the width of said slot being sufficient to permit rotational displacement of said other ends of said elements one from the other when said other ends are disconnected, whereby keys and the like may be installed and removed from said elements.

* * * * *